US008136370B2

(12) United States Patent
Bennett

(10) Patent No.: US 8,136,370 B2
(45) Date of Patent: Mar. 20, 2012

(54) SILVER-PALLADIUM ALLOY

(75) Inventor: Charles Bennett, Carson, CA (US)

(73) Assignee: American Bullion Investment Company, Inc., Carson, CA (US)

( * ) Notice: Subject to any disclaimer, the term of this patent is extended or adjusted under 35 U.S.C. 154(b) by 0 days.

(21) Appl. No.: 12/371,396

(22) Filed: Feb. 13, 2009

(65) Prior Publication Data

US 2009/0205369 A1 Aug. 20, 2009

Related U.S. Application Data

(60) Provisional application No. 61/029,266, filed on Feb. 15, 2008.

(51) Int. Cl.
*C22C 5/06* (2006.01)

(52) U.S. Cl. ..... 63/33; 420/503; 420/505

(58) Field of Classification Search ..... None
See application file for complete search history.

(56) References Cited

U.S. PATENT DOCUMENTS

| | | | | |
|---|---|---|---|---|
| 4,810,308 | A | 3/1989 | Eagar et al. | |
| 4,869,757 | A | 9/1989 | Eagar et al. | |
| 4,973,446 | A * | 11/1990 | Bernhard et al. | 420/504 |
| 5,037,708 | A * | 8/1991 | Davitz | 428/673 |
| 5,039,479 | A | 8/1991 | Bernhard et al. | |
| 5,171,643 | A | 12/1992 | Suzuki et al. | |
| 5,558,833 | A | 9/1996 | Zamojski | |
| 5,817,195 | A * | 10/1998 | Davitz | 148/430 |
| 5,882,441 | A | 3/1999 | Davitz | |
| 6,139,652 | A | 10/2000 | Carrano et al. | |
| 6,168,071 | B1 | 1/2001 | Johns | |
| 6,406,664 | B1 | 6/2002 | Diamond | |
| 6,726,877 | B1 * | 4/2004 | Eccles | 420/504 |
| 6,841,012 | B2 * | 1/2005 | Croce | 148/430 |
| 6,860,979 | B2 | 3/2005 | Weber | |
| 7,118,707 | B2 * | 10/2006 | Robinson | 420/503 |
| 7,128,792 | B2 | 10/2006 | Menon | |
| 7,128,871 | B2 * | 10/2006 | Davitz | 420/504 |
| 7,198,683 | B2 * | 4/2007 | Agarwal et al. | 148/431 |
| 2005/0220659 | A1 * | 10/2005 | Robinson | 420/503 |
| 2008/0166260 | A1 | 7/2008 | Faverjon et al. | |

* cited by examiner

*Primary Examiner* — Jack Lavinder
(74) *Attorney, Agent, or Firm* — Knobbe, Martens, Olson & Bear, LLP

(57) ABSTRACT

A silver-palladium alloy formulated to provide an alloy with a whiter color and superior casting and fabrication properties as compared to nickel-based white gold and also to impart to an article of jewelry or the like favorable properties afforded by white gold. The alloy generally includes silver and palladium, with silver being the predominant component. In some embodiments, the alloy contains about 75%-85% silver and about 5%-15% palladium by weight.

8 Claims, No Drawings

SILVER-PALLADIUM ALLOY

CROSS-REFERENCE TO RELATED APPLICATIONS

This application claims the benefit of priority under 35 U.S.C. §119(e) of U.S. Provisional Application No. 61/029,266 filed on Feb. 15, 2008, the entirety of which is incorporated herein by reference.

BACKGROUND OF THE INVENTION

1. Field of the Invention

This invention relates generally to metal alloys, and more particularly relates to compositions of certain silver-palladium alloys for use in jewelry manufacturing.

2. Description of the Related Art

White gold is a metal alloy widely used in the fabrication of jewelry. It has a composition typically consisting of gold and at least one white metal such as nickel. White gold alloy is usually provided to jewelry manufacturers in the form of pellet-like shots. The shots can be melted and cast into desired forms using conventional investment casting techniques. Nickel-based white gold in particular is a preferred material for jewelry because it provides certain desirable properties to the final product, including shine, luster, strength, hardness, and tarnish-resistance. However, one disadvantage associated with using such white gold alloy is that it is costly largely due to the high cost of gold. As such, there is a need for an alternative alloy which is lower in cost and yet still provides the advantages afforded by white gold alloys.

SUMMARY OF THE INVENTION

The preferred embodiments of the present invention have several features, no single one of which is solely responsible for their desirable attributes. Without limiting the scope of this invention, its more prominent features will now be discussed briefly. However, not all of the following features are necessary to achieve the advantages of the metal alloy preferred embodiments. Therefore, none of the following features should be viewed as limiting. After considering this discussion, and particularly after reading the section entitled "Detailed Description of the Preferred Embodiments," one will understand how the features of the preferred embodiments provide advantages over prior art alloy compositions. The preferred embodiments of the present invention provide a metal alloy that has many of the desired properties of white gold and yet is lower in cost than white gold.

In one embodiment, the present invention provides a metal alloy comprising about 75%-85% silver and about 5%-15% palladium by weight, more preferably about 5%-10% palladium, more preferably about 5%-7% palladium, more preferably about 5% palladium. In another embodiment, the alloy further comprises about 0.5%-2% indium by weight. In yet another embodiment, the alloy further comprises about 0.5%-2% gallium by weight. In yet another embodiment, the alloy further comprises about 0%-4% gold by weight. In yet another embodiment, the alloy further comprises about 0%-2% platinum by weight. In yet another embodiment, the alloy further comprises about 0%-0.2% silicon by weight. In yet another embodiment, the alloy further comprises about 3%-6% copper by weight. In yet another embodiment, the alloy further comprises about 0%-2% tin by weight. In yet another embodiment, the alloy further comprises about 0%-2% zinc by weight. Preferably, the alloy has a tarnish resistance that is substantially equivalent to the tarnish resistance of 10 karat gold.

In another embodiment, the present invention provides a metal alloy composition consisting essentially of about 5%-15% palladium by weight, more preferably about 5%-10% palladium, more preferably about 5%-7% palladium, more preferably about 5% palladium, about 75%-85% silver by weight, about 0%-4% gold by weight, about 0%-2% platinum by weight, about 0%-0.2% silicon by weight, about 3%-6% copper by weight, about 0%-2% tin by weight, and about 0%-2% zinc by weight. In yet another embodiment, the present invention provides a metal alloy composition consisting essentially of about 5%-15% palladium by weight, about 75%-85% silver by weight, about 0.5%-2% indium by weight, about 0.5%-2% gallium by weight, about 0%-4% gold by weight, about 0%-2% platinum by weight, about 0%-2% silicon by weight, about 3%-6% copper by weight, about 0%-2% tin by weight, and about 0%-2% zinc by weight. The metal alloy can be used to manufacture jewelry, selected from the group consisting of bracelet, ring, necklace, brooch, cuff links, pin, and watch. Preferably, the metal alloy has a whiter color, superior casting and fabrication properties as compared to nickel-based white karat gold alloys.

DETAILED DESCRIPTION OF THE PREFERRED EMBODIMENT

Preferred embodiments of the present invention provide certain metal alloys that are formulated with a composition that imparts to an article of jewelry or the like favorable properties afforded by white gold, and additionally, also provides the alloy with a whiter color and superior casting and fabrication properties as compared to nickel-based white gold. In one embodiment, the metal alloy generally comprises silver and palladium, with silver being the predominant component. Predominant component is herein defined as a component that is greater than 50% by weight of the total weight of the alloy. Preferably, both the silver and palladium incorporated are at least 99.5% pure, more preferably about 99.9% pure.

In one embodiment, the alloy comprises between about 75%-85% silver and about 5%-15% palladium by weight. In certain implementations, the alloy also comprises a reduced amount of gallium, preferably between about 0.5%-2% gallium by weight. In certain other implementations, the alloy also comprises a reduced amount of indium, preferably between about 0.5%-2% indium by weight. The gallium and indium are preferably added to improve the hardness and castability of the alloy. In certain other implementations, the alloy also comprises a reduced amount of platinum, preferably between about 0.1%-0.25% platinum by weight. The platinum is preferably added to increase the hardness and create more product durability. In certain embodiments, platinum is used as an additive to act on the silver as a grain refiner. A grain refiner tightens the molecules of the alloy and thus provides a brighter and superior surface finish. Moreover, the gallium also tightens the grain structure by helping to bond the metals together. Bonding the metals is one of the attributes of adding gallium. Gallium, together with the platinum grain refiner, gives the alloy a brighter and superior surface finish. In certain other implementations, the alloy also comprises a reduced amount of gold, preferably between about 0.1%-0.4% gold by weight. The gold also creates a tighter metallic grain structure and improves casting properties. In other implementations, the alloy further comprises additives selected from the group consisting of silicon, copper, tin, zinc and mixtures thereof. Both zinc and silicon have anti-tarnish and anti-corrosion qualities and zinc, in particular, also helps the workability of the alloy and makes it more forgiving in the manufacturing process for jewelry. In one embodiment, the alloy composition further comprises about 0.01%-0.2% silicon, about 3%-6% copper, about 0.1%-2% tin, and about 0.1%-2% zinc by weight. Preferably, the alloy is nickel-free.

Table 1 below provides metal alloy formulations of certain preferred embodiments of the present invention:

TABLE 1

| | Formulation 1 | Formulation 2 | Formulation 3 |
|---|---|---|---|
| Silver (Wt. %) | about 81 | about 81 | about 81 |
| Palladium (Wt. %) | about 10 | about 10 | about 10 |
| Platinum (Wt. %) | 0 | about 0.25 | about 0.10 |
| Gold (Wt. %) | 0 | 0 | about 0.25 |
| Copper (Wt. %) | about 4.7 | about 4.7 | about 3.91 |
| Zinc (Wt. %) | about 0.75 | about 0.5 | about 1.17 |
| Gallium (Wt. %) | about 1.25 | about 1.25 | about 1.25 |
| Indium (Wt. %) | about 1.75 | about 1.75 | about 1.75 |
| Tin (Wt. %) | about 0.5 | about 0.5 | about 0.5 |
| Silicon (Wt. %) | about 0.05 | about 0.05 | about 0.05 |

Table 2 below provides formulation of a silver-palladium composition of another embodiment of the present invention.

| | | | |
|---|---|---|---|
| Silver (Wt. %) | about 86 | about 85 | about 85 |
| Palladium (Wt. %) | about 5 | about 5 | about 5 |
| Platinum (Wt. %) | 0 | about 0.25 | about 0.10 |
| Gold (Wt. %) | 0 | 0 | about 0.25 |
| Copper (Wt. %) | about 4.7 | about 4.7 | about 3.91 |
| Zinc (Wt. %) | about 0.75 | about 0.5 | about 1.17 |
| Gallium (Wt. %) | about 1.25 | about 1.25 | about 1.25 |
| Indium (Wt. %) | about 1.75 | about 1.75 | about 1.75 |
| Tin (Wt. %) | about 0.5 | about 0.5 | about 0.5 |
| Silicon (Wt. %) | about 0.05 | about 0.05 | about 0.05 |

Table 3 below provides formulation of a silver-palladium composition of another embodiment of the present invention.

TABLE 3

| | |
|---|---|
| Silver (Wt. %) | about 75-85% |
| Palladium (Wt. %) | about 5-15% |
| Indium (Wt. %) | about 0.5-2% |
| Gallium (Wt. %) | about 0.5-2% |
| Gold (Wt. %) | about 0.1-4% |
| Platinum (Wt. %) | about 0.1-2% |
| Silicon (Wt. %) | about 0.01-0.2% |
| Copper (Wt. %) | about 3-6% |
| Tin (Wt %) | about 0.1-2% |
| Zinc (Wt %) | about 0.1-2% |

Table 4 below provides formulation of a silver-palladium composition of another embodiment of the present invention.

TABLE 4

| | |
|---|---|
| Silver (Wt. %) | about 75-85% |
| Palladium (Wt. %) | about 5-15% |
| Indium (Wt. %) | about 0.5-2% |

TABLE 4-continued

| | |
|---|---|
| Gallium (Wt. %) | about 0.5-2% |
| Gold (Wt. %) | about 0-4% |
| Platinum (Wt. %) | about 0-2% |
| Silicon (Wt. %) | about 0-0.2% |
| Copper (Wt. %) | about 3-6% |
| Tin (Wt %) | about 0-2% |
| Zinc (Wt %) | about 0-2% |

The metal alloy of the preferred embodiments described above can be formed into various shapes and sizes for jewelry manufacturing. The alloy can be formed into grains, sheets, wires, and tubing for various applications.

Although the foregoing description of the preferred embodiments of the present invention has shown, described and pointed out the fundamental novel features of the invention, it will be understood that various omissions, substitutions, and changes in the form of the details of the invention as illustrated as well the uses thereof, may be made by those skilled in the art, without departing from the spirit of the invention. Consequently, the scope of the invention should not be limited to the foregoing discussions.

What is claimed is:

1. A metal alloy having a composition consisting essentially of about 75%-85% silver by weight, about 5%-15% palladium by weight, about 0%-4% gold by weight, about 0%-2% platinum by weight, about 0%-0.2% silicon by weight, about 3%-6% copper by weight, about 0%-2% tin by weight, about 0.5%-2% gallium by weight, and about 0%-2% zinc by weight.

2. The alloy of claim 1, wherein the palladium is about 5%-7% by weight.

3. The alloy of claim 2, wherein the palladium is about 5% by weight.

4. A jewelry item comprising the alloy composition of claim 1, said jewelry item is selected from group consisting of bracelet, ring, necklace, brooch, cuff links, pin and watch.

5. The alloy of claim 1 is formed into a configuration selected from the group consisting of grains, sheets, and tubes.

6. A metal alloy having a composition consisting essentially of about 75%-85% silver by weight, about 5%-15% palladium by weight, about 0%-4% gold by weight, about 0%-2% platinum by weight, about 0%-0.2% silicon by weight, about 3%-6% copper by weight, about 0%-2% tin by weight, and about 0%-2% zinc by weight.

7. The alloy of claim 6 further comprising about 0.5%-2% indium by weight.

8. A metal alloy having a composition consisting essentially of about 81% silver by weight, about 5%-7% palladium by weight, about 4.7% copper by weight, about 0.75 zinc by weight, about 1.25% gallium by weight, about 1.75 indium by weight, about 0.5% tin by weight, and about 0.05% silicon by weight.

* * * * *